US006265833B1

(12) United States Patent
Kim et al.

(10) Patent No.: US 6,265,833 B1
(45) Date of Patent: Jul. 24, 2001

(54) APPARATUS AND METHOD FOR DRIVING SELF-EMITTING DISPLAY DEVICE

(75) Inventors: Sung Tae Kim; Moo Seop Kim, both of Seoul; Hak Su Kim; Eun Young Lee, both of Kyonggi-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/436,730

(22) Filed: Nov. 9, 1999

(30) Foreign Application Priority Data

Nov. 20, 1998 (KR) ..... 98/49934

(51) Int. Cl.[7] ..... G09G 3/10

(52) U.S. Cl. ..... 315/169.3; 315/149; 315/291; 315/307

(58) Field of Search ..... 315/169.3, 291–294, 315/299, 300, 301, 307, 308, 149–159, 224, 225; 362/800

(56) References Cited

U.S. PATENT DOCUMENTS 3,828,220 * 8/1974 Moore et al. ..... 315/82
3,999,193 * 12/1976 Hasegawa ..... 354/33
4,697,122 * 9/1987 Hoffer ..... 315/158
5,453,866 * 9/1995 Gross ..... 359/144
5,663,613 * 9/1997 Yamashita et al. ..... 315/308
5,668,446 * 9/1997 Baker ..... 315/294
5,861,717 * 1/1999 Begemann et al. ..... 315/158
5,900,701 * 5/1999 Guhilot et al. ..... 315/307
5,933,089 * 8/1999 Katada ..... 340/825.44
5,936,361 * 8/1999 Yamashita ..... 315/308
5,990,628 * 11/1999 Birrell ..... 315/151

* cited by examiner

*Primary Examiner*—Don Wong
*Assistant Examiner*—Tuyet T. Vo
(74) *Attorney, Agent, or Firm*—Fleshner & Kim, LLP

(57) ABSTRACT

An apparatus and method for driving a self-emitting display device is provided, in which a driving voltage and a driving current are linearly controlled in accordance with variation of the outside environment to automatically control emitting luminance of the display device. The apparatus for driving a self-emitting display device provided with an optical signal converter and a display device includes: a controller for outputting a control signal for converting a predetermined driving current and driving voltage in accordance with a signal converted by the optical signal converter and a signal indicating whether or not the display device is in use; and a driver for simultaneously converting the driving current and driving voltage applied to the display device to a linear driving current and driving voltage in accordance with the control signal output from the controller, so that emitting luminance of the display device is automatically controlled and at the same time power consumption is optimally set. The method for driving a self-emitting display device includes the steps of sensing the intensity of light in the outside environment, converting the sensed intensity of light to an electrical signal, detecting a driving mode corresponding to the electrical signal, and controlling driving power of the self-emitting display device in accordance with the driving mode, so that power consumption is small and eyestrain of a user is removed.

18 Claims, 3 Drawing Sheets

APPARATUS AND METHOD FOR DRIVING SELF-EMITTING DISPLAY DEVICE

BACKGROUND OF THE INVENTION

1. Field of the Invention

The present invention relates to a self-emitting display device, and more particularly, to an apparatus and method for driving a self-emitting display device.

2. Background of the Related Art

Generally, a self-emitting display device spontaneously emits a light when electric power or other energy is applied thereto. There are an organic electroluminescence (EL) display, an inorganic light emitting diode, an inorganic EL display, a field effect display, a plasma display panel, and the like in the self-emitting display device.

The self-emitting display device has good visibility outer illumination is low. On the contrary, the self-emitting display device has poor visibility as outer illumination is high. For example, visibility becomes poor in the outside environment where the intensity of light is high.

Most of the self-emitting display devices have a number of control switches which intermittently vary their emitting luminance or control knobs which gradually vary their emitting luminance, so that a user can control emitting luminance using the control switch or the control knob if the intensity of light in the outside environment is high. However, in this case, since the user should directly control emitting luminance of the display device in accordance with the use environment, there brings the user inconvenience and also there are no benefits in time and effects.

To solve such problems, there has been proposed a method for automatically controlling emitting luminance of a display device in which an optical sensor is used to senses the brightness of the outside environment. This method is adapted to control the brightness of a back light of a liquid crystal display (LCD) not a self-emitting display device. The method for automatically controlling emitting luminance of a display device includes the steps of sensing brightness of the outside environment by the optical sensor, and controlling the electric power applied to the back light in accordance with the brightness to automatically control the emitting luminance of the display device. In this method, in the case that the outside environment is dark, it is determined whether the intensity of light in the outside environment sensed by the optical sensor is less than a reference value. If so, the emitting luminance of the display device increases by increasing the electric power applied to the back light more than the reference value. In the case that the outside environment is bright, the emitting luminance of the display device decreases by decreasing the electric power applied to the back light less than the reference value. As a result, the emitting luminance of the display device can be controlled automatically.

Since this method automatically controls the emitting luminance of the display device, power consumption can be reduced and inconvenience of the user can be removed. However, since the electric power of the back light increases or decreases in accordance with the intensity of light of the outside environment, it makes the sight of the user unstable, thereby causing fatigue to the user. In other words, it is difficult to distinguish images or information characters when the emitting luminance of the display device is too low, while glaring occurs when the emitting luminance of the display device is too high, thereby reducing efficiency of work and causing eyestrain.

SUMMARY OF THE INVENTION

Accordingly, the present invention is directed to an apparatus and method for driving a self-emitting display device, that substantially obviates one or more of the problems due to limitations and disadvantages of the related art.

An object of the present invention is to provide an apparatus and method for driving a self-emitting display device, in which a driving voltage and a driving current are controlled in accordance with variation of the outside environment to automatically control emitting luminance of the display device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for driving a self-emitting display device provided with an optical signal converter for converting external light and a display device, according to the present invention includes: a controller for a control signal for converting a predetermined driving current and driving voltage in accordance with a signal converted by the optical signal converter and a signal indicating whether or not the display device is in use; and a driver for simultaneously converting the driving current and driving voltage in accordance with the control signal output from the controller, and automatically controlling emitting luminance of the display device and at the same time optimally setting power consumption.

In another aspect, an apparatus for driving a self-emitting display device provided with an optical signal converter for converting external light and a display device includes: a controller for selecting driving modes corresponding to a predetermined driving current and driving voltage in accordance with a signal converted by the optical signal converter and a signal indicating whether or not the display device is in use, and outputting a corresponding driving mode control signal; and a driver for simultaneously converting the driving current and driving voltage applied to the display device in accordance with the driving mode control signal output from the controller, and automatically controlling emitting luminance of the display device and at the same time optimally setting power consumption.

It is characterized in that the controller includes a driving mode selector for selecting a driving mode corresponding to a predetermined driving current and driving voltage in accordance with the signal converted by the optical signal converter and the signal indicating whether or not the display device is in use.

It is characterized in that the driver includes a driving current controller for controlling the driving current in accordance with the driving mode control signal of the controller, a driving voltage controller for controlling an actual driving voltage of the driving voltage in accordance with the driving mode control signal of the controller, a driving voltage generator for generating an actual driving voltage corresponding to the control signal output from the driving voltage controller, and a driving driver for driving the display device in accordance with the driving current output from the driving current controller and the actual driving voltage generated by the driving voltage generator, and controlling the emitting luminance.

In other aspect, a method for driving a self-emitting display device in which the intensity of light of the outside environment is sensed to convert the sensed intensity of light to an electrical signal, includes the steps of: detecting whether or not a display device is in use; outputting a control signal for converting a predetermined driving current and driving voltage in accordance with the converted electrical signal; controlling levels of the predetermined driving current and driving voltage in accordance with the control signal to set levels of an actual driving current and an actual driving voltage; and automatically controlling emitting luminance of the display device in accordance with the level of the predetermined driving current and the level of the actual driving voltage.

It is characterized in that the detecting step includes steps of outputting a control signal for converting the predetermined driving current and driving voltage at a minimum value if the display device is not in use, and setting a minimum driving current level and a minimum driving voltage level corresponding to a minimum driving current/voltage in accordance with the control signal.

In still another aspect, a method for driving a self-emitting display device in which the intensity of light of the outside environment is sensed to convert the sensed intensity of light to an electrical signal, includes the steps of: detecting whether or not a display device is in use; outputting a driving mode signal for linearly controlling a driving current and driving voltage by comparing the converted electrical signal with predetermined reference values; setting and a level of a driving current and a level of an actual driving voltage of the driving voltage in accordance with the driving mode control signal; and automatically controlling emitting luminance of the display device in accordance with the set driving current level and actual driving voltage level.

It is characterized in that the step of outputting the driving mode control signal includes the steps of selecting a first driving mode by setting the driving current and the actual driving voltage at a minimum value if the display device is not in use as a result of the detecting step to control the emitting luminance of the display device, comparing the converted electrical signal with the predetermined first reference value if the display device is in use, and selecting second to fourth driving modes in accordance with the compared result.

It is characterized in that the step of selecting the second to fourth driving modes includes the steps of selecting the second driving mode if the converted electrical signal is less than the first reference value, comparing the converted electrical signal with the second reference value if the converted electrical signal is greater than the first reference value, selecting the third driving mode if the converted electrical signal is less than the second reference value, and selecting the fourth driving mode if the converted electrical signal is greater than the second reference value.

In still other aspect, a method for driving a self-emitting display device in which the intensity of light of the outside environment is sensed to convert the sensed intensity of light to an electrical signal, includes the steps of: detecting whether or not a display device is in use; selecting a first driving mode by setting a driving current and an actual driving voltage at a minimum value if the display device is not in use, to control emitting luminance of the display device; comparing the converted electrical signal with a predetermined first reference value if the display device is in use; selecting a second driving mode if the converted electrical signal is less than the first reference value; comparing the converted electrical signal with a second reference value if the converted electrical signal is greater than the first reference value; selecting a third driving mode if the converted electrical signal is less than the second reference value; selecting a fourth driving mode if the converted electrical signal is greater than the second reference value; setting a level of the driving current and a level of an actual driving voltage of the driving voltage in accordance with the selected driving mode; and automatically controlling the emitting luminance of the display device in accordance with the set driving current level and actual driving voltage level.

It is characterized in that the first to fourth driving modes are set in accordance with a step wave form or a linear wave form varied by the outside environment.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
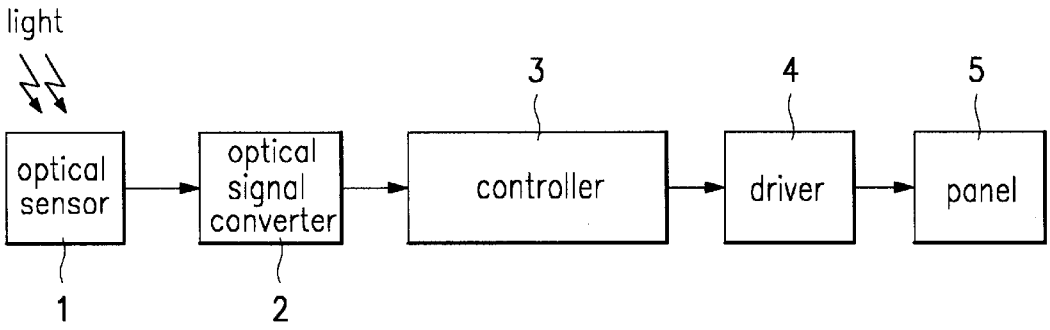
FIG. 1 is a block diagram showing a self-emitting display device according to an embodiment of the present invention.

FIG. 1 is a block diagram showing a self-emitting display device according to an embodiment of the present invention.

As shown in FIG. 1, the self-emitting display device includes an optical sensor 1, an optical signal converter 2, a controller 3, a driver 4, and a panel 5. The optical sensor 1 senses the intensity of light depending on variation of the outside environment. The optical signal converter 2 converts a signal sensed by the optical sensor 1 to an electrical signal. The controller 3 outputs a control signal for converting a predetermined driving current and driving voltage in accordance with a signal converted by the optical signal converter 2 and a signal indicating whether or not the panel is in use. The driver 4 simultaneously converts the driving current and driving voltage in accordance with the control signal output from the controller 3 so that emitting luminance of the display device is automatically controlled and at the same time power consumption is optimally set. The panel displays characters, numbers, pictures and the like in accordance with the driving current and driving voltage output from the driver 4 so that the emitting luminance is controlled and at the same time power consumption is optimally set.

Figure 2:
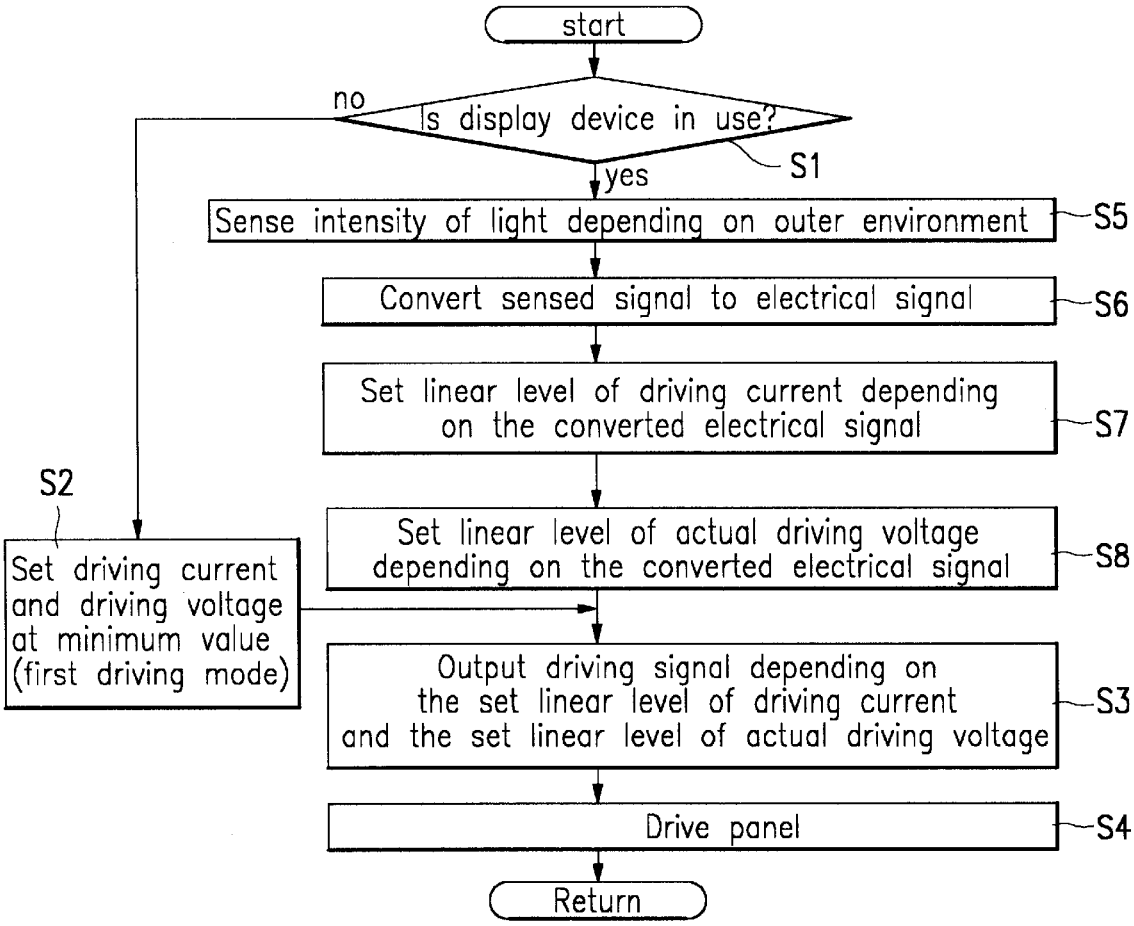
FIG. 2 is a flow chart showing a method for driving a self-emitting display device according to an embodiment of the present invention.
Figure 3:
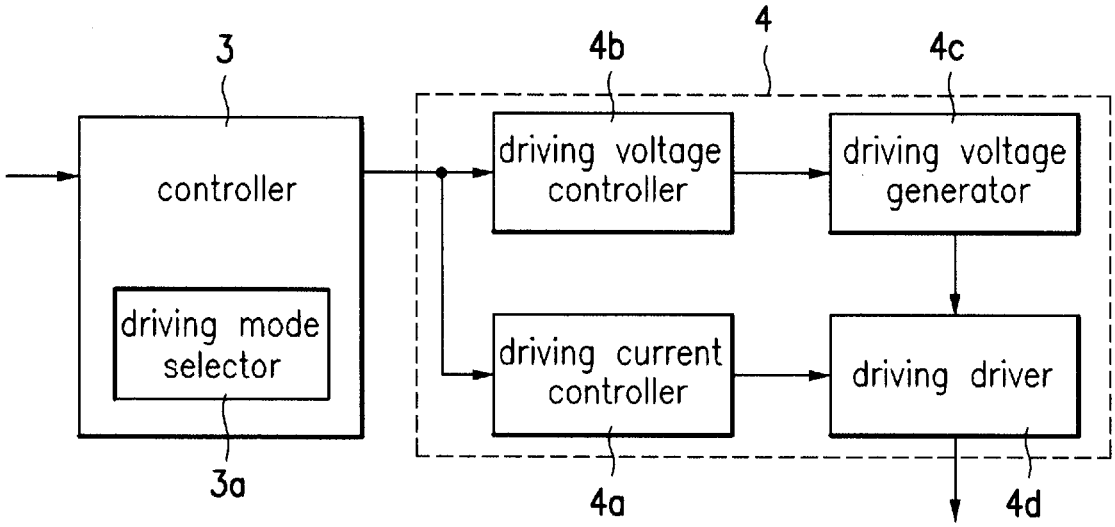
FIG. 3 is a block diagram showing a self-emitting display device according to other embodiment of the present invention.

FIG. 2 is a flow chart showing a method for driving a self-emitting display device according to an embodiment of the present invention, and FIG. 3 is a block diagram showing a self-emitting display device according to other embodiment of the present invention, in which the controller 3 and the driver 4 are shown in detail.

As shown in FIG. 3, the controller 3 includes a driving mode selector 3*a* for selecting driving modes corresponding to optimal driving current and driving voltage in accordance with the signal converted by the optical signal converter 2 and the signal indicating whether or not the panel is in use. The driver 4 includes a driving current controller 4*a* for controlling the driving current in accordance with the driving mode control signal of the controller 3, a driving voltage controller 4*b* for controlling an actual driving voltage in accordance with the driving mode control signal of the controller 3, a driving voltage generator 4*c* for generating an actual driving voltage corresponding to a control signal output from the driving voltage controller 4*b*, and a driving driver 4*d* for driving the panel 5 in accordance with the driving current output from the driving current controller 4*a* and the actual driving voltage generated by the driving voltage generator 4*c*, and controlling the emitting luminance. The panel acts as a display device.

Figure 4:
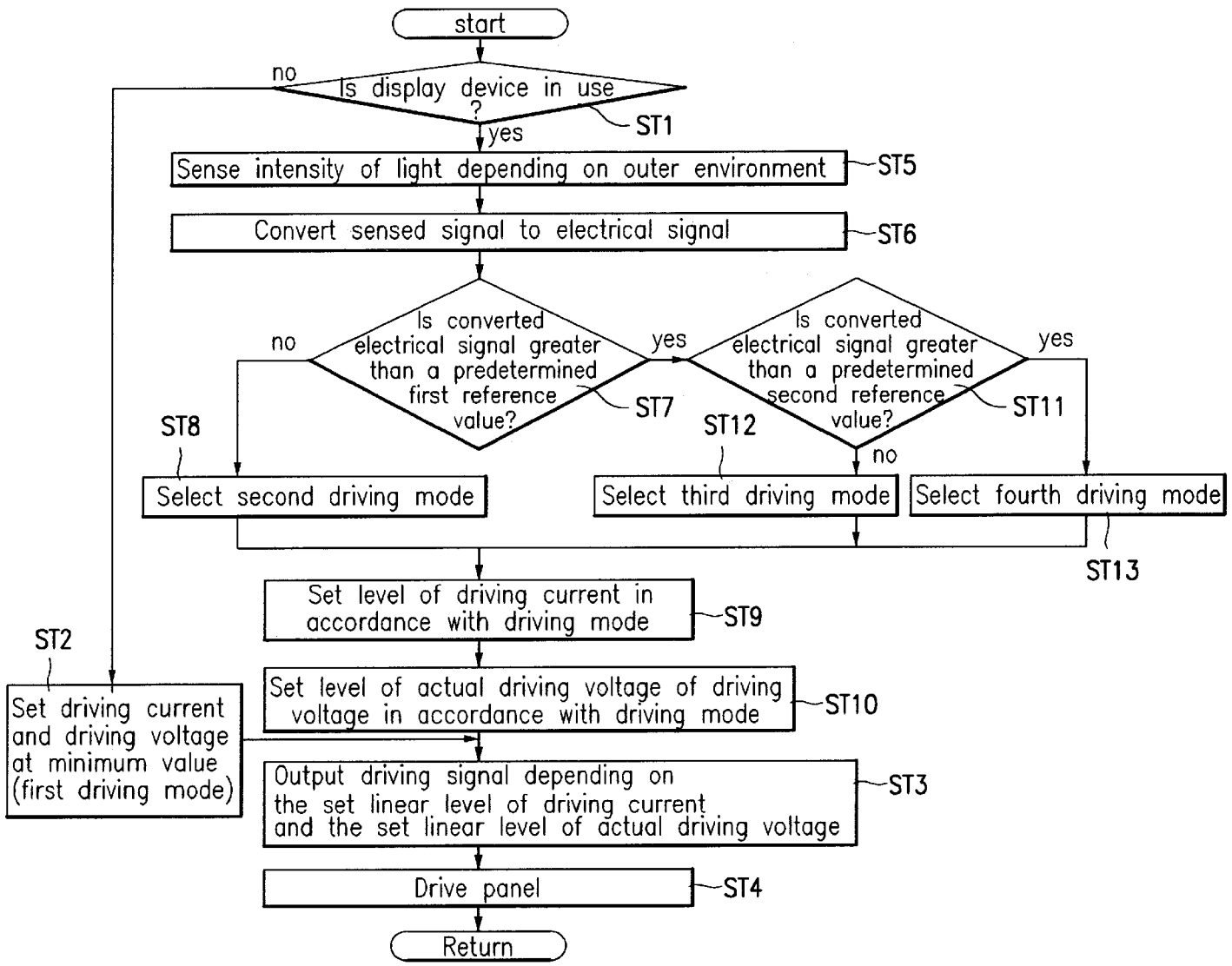
FIG. 4 is a flow chart showing a method for driving a self-emitting display device according to other embodiment of the present invention.

FIG. 4 is a flow chart showing a method for driving a self-emitting display device according to other embodiment of the present invention.

The apparatus and method for driving a self-emitting display device according to the present invention will be described with reference to the accompanying drawings.

First, the optical sensor 1 senses the intensity of light depending on variation of the outside environment and outputs the sensed signal. Then, the optical signal converter 2 converts the sensed signal to an electrical signal. The controller 3 outputs a control signal for selecting optimal driving voltage and driving current required for driving in accordance with a signal converted by the optical signal converter 2 and a signal indicating whether or not the display device is in use. To set optimal driving voltage and driving current, levels of a driving voltage and a driving current are set to be linearly varied according to the outer environment and whether or not the display device is in use. Alternatively, levels of optimal driving voltage and driving current are set for each mode by distinguishing driving modes in step wave forms according to the outer environment and whether or not the display device is in use.

Here, the method for controlling the driving voltage and driving current linearly varied according to the outer environment and whether or not the display device is in use will be described. The controller 3 detects whether or not the panel 5 is in use.

If the panel is not in use, the controller 3 outputs a control signal for converting a predetermined driving current and driving voltage to a driving current of a minimum value and an actual driving voltage of a minimum value (S1).

The driver 4 sets the predetermined driving current and driving voltage to the driving current of the minimum value and the actual driving voltage of the minimum value in accordance with the control signal output from the controller 3 and outputs a corresponding driving signal (S2, S3).

Then, the panel 5 displays characters, numbers, figures, and the like so that the driving current of the minimum value and the actual driving voltage are simultaneously controlled in accordance with the driving signal output from the driver 4, and power consumption is optimally set (S4). The driving current and driving voltage are controlled to linearly set optimal levels of the driving current and driving voltage in accordance with the control signal output from the controller 3.

Meanwhile, if the panel is in use, the controller 3 outputs a control signal for linearly converting the predetermined driving current to a corresponding driving current in accordance with the electrical signal converted by the optical signal converter 2 (S5~S7).

The controller 3 also outputs a control signal for linearly converting the predetermined driving voltage to a corresponding actual driving voltage in accordance with the electrical signal converted by the optical signal converter 2 (S8).

The driver 4 controls the predetermined driving current to a corresponding driving current level in accordance with the control signal output from the controller 3 and controls the predetermined driving voltage to a corresponding actual driving voltage. Then, the driver 4 outputs a driving signal to optimally set power consumption (S3).

Then, the panel 5 displays characters, numbers, figures, and the like so that the driving current and the driving voltage are simultaneously controlled in accordance with the driving signal output from the driver 4, and power consumption is optimally set (S4).

Consequently, it is possible to maintain good visibility without unnecessary power consumption. It is more effective to apply such a function to portable electronic products such as a cellular phone.

The self-emitting display device according to other embodiment of the present invention will be described with reference to FIG. 3.

As shown in FIG. 3, the optical sensor 1 senses the intensity of light depending on variation of the outside environment and outputs the sensed signal.

The optical signal converter 2 converts the sensed signal to an electrical signal.

The controller 3 includes a plurality of driving modes in which optimal driving current and optimal driving voltage required for driving are set in a step wave form in accordance with the signal converted by the optical signal converter 2 and the signal indicating whether or not the display device is in use, and outputs a corresponding driving mode control signal in accordance with the signal of the optical signal converter.

In other words, if a driving mode selector 3*a* in the controller 3 selects a driving mode corresponding to the predetermined driving current and driving voltage in accordance with the signal converted by the optical signal converter 2 and the signal indicating whether or not the display device is in use, the controller 3 outputs a corresponding driving mode control signal.

As aforementioned, in case of the plurality of driving modes, it is possible to simply control the driving voltage and the driving current as compared with that the driving voltage and the driving current are linearly controlled. In the present invention, four driving modes are set in accordance with the signal indicating whether or not the display device is in use and the outer environment. More driving modes or less driving modes may be set in accordance with the use environment.

Setting conditions depending on a number of driving modes are previously stored in the driving mode selector 3*a* to select the optimal driving current and driving voltage. The setting conditions are as follows: voltage of 6V and current of 10$\mu$ in case of the first driving mode; voltage of 9V and current of 100$\mu$ in case of the second driving mode; voltage of 12V and current of 350$\mu$ in case of the third driving mode; and voltage of 15V and current of 500$\mu$ in case of the fourth driving mode. The driving modes are preset as the first to fourth driving modes. More driving modes may be set.

The first driving mode is used in the indoor or the outdoor at night, the second driving mode in the bright indoor or the rainy outdoor, the third driving mode in the cloudy and shaded outdoor, and the fourth driving mode in the bright outdoor.

The driver 4 outputs the predetermined driving current and the actual driving voltage in accordance with the driving mode control signal output from the controller 3.

In other words, as shown in FIG. 3, the driving current controller 4*a* in the driver 4 controls the driving current in accordance with the driving mode control signal of the controller 3. The driving voltage controller 4*b* outputs a signal for controlling the actual driving voltage in accordance with the driving mode control signal of the controller 3. The reason why the driving voltage controller 4*b* controls the actual driving voltage instead of the predetermined driving voltage is to improve voltage efficiency when boosting a voltage for the self-emitting display device driven by the current, which requires a boosted voltage. Then, the driving voltage generator 4*c* generates the actual driving voltage corresponding to the control signal output to the driving voltage controller 4*b*.

The self-emitting display device is any one of an organic field emitting display device, an inorganic field emitting display device, an inorganic emitting diode, and a field effect display device.

The driving driver 4*d* drives the panel 5 in accordance with the driving current output from the driving current controller 4*a* and the actual driving voltage generated by the driving voltage generator 4*c*, so that the emitting luminance is linearly controlled in accordance with the intensity of light of the outside environment. As a result, it is possible to maintain good visibility without unnecessary power consumption.

FIG. 4 is a flow chart showing a method for driving a self-emitting display device according to other embodiment of the present invention.

The method for driving a self-emitting display device according to other embodiment of the present invention will be described with reference to FIG. 4.

The controller 3 detects whether or not the display device of the self-emitting display device is in use, sets a driving current and driving voltage at a minimum value, i.e., the first driving mode, if the display device is not in use, and outputs a driving mode control signal corresponding to the first driving mode (ST1).

The driver 4 outputs the driving current of the minimum value and the actual driving voltage corresponding to the driving voltage of the minimum value of the first driving mode in accordance with the driving mode control signal output from the controller 3 (ST2).

In other words, the driving current controller 4*a* in the driver 4 controls the driving current of the minimum value according to the first driving mode preset by the driving mode control signal of the controller 3. The driving voltage controller 4*b* outputs a signal for controlling the actual driving voltage corresponding to the driving voltage of the minimum value according to the first driving mode preset by the driving mode control signal of the controller 3. The driving voltage generator 4*c* generates the actual driving voltage corresponding to the first driving mode in accordance with the control signal output to the driving voltage controller 4*b*. The driving driver 4*d* drives the panel 5 in the first driving mode with the driving current and driving voltage of the minimum value in accordance with both the driving current output from the driving current controller 4*a* and the actual driving voltage of the first driving mode generated by the driving voltage generator 4*c* (ST3 and ST4).

Meanwhile, the optical sensor 1 senses the intensity of light depending on variation of the outside environment and outputs the sensed signal (ST5).

The optical signal converter 2 converts the sensed intensity of light to a corresponding electrical signal (ST6).

The controller 3 detects whether or not the converted electrical signal is greater than a first reference value when the display device is in use (ST7).

As a result, if the converted electrical signal is not greater than the first reference value, the driving mode selector 3*a* in the controller 3 selects the second driving mode and the controller 3 outputs a driving mode control signal of the second driving mode (ST8).

Since the optical sensor 1 does not distinguish between the indoor and outdoor or day and night, the driving mode selector 3*a* in the controller 3 measures only the outside illumination and compares the outside illumination with the set reference value so as to select any one of the respective modes.

In the case that a clock is mounted in the system or the system is designed to recognize time by an externally input signal, it is possible to distinguish between day and night and control the system by time.

The above driving modes are provided as examples. Various driving modes may be provided according to application.

The panel of the self-emitting display device in the respective driving modes may always be emitted as far as the electric power is applied, or may be emitted as occasion demands. For example, the panel is always emitted in case of the first and second driving modes while the panel is emitted for a certain time in case of the third and fourth driving modes. Thus, it is possible to maintain good visibility without unnecessary power consumption. It is more effective to apply such a function to portable electronic products such as a cellular phone.

Then, the driver 4 outputs the driving current and the actual driving voltage of the driving voltage corresponding to the second driving mode in accordance with the driving mode control signal output from the controller 3 (ST9 and ST10).

In other words, the driving current controller 4*a* in the driver 4 controls the driving current of the second driving mode in accordance with the driving mode control signal of the controller 3. The driving voltage controller 4*b* outputs a signal for controlling the actual driving voltage corresponding to the driving voltage of the second driving mode in accordance with the driving mode control signal of the controller 3. The driving voltage generator 4*c* generates the actual driving voltage corresponding to the second driving mode in accordance with the control signal output from the driving voltage controller 4*b*. The driving driver 4*d* drives the panel in the second driving mode in accordance with both the driving current output from the driving current controller 4*a* and the actual driving voltage of the second driving mode generated by the driving voltage generator 4*c* (ST3 and ST4).

Meanwhile, if the converted electrical signal is not greater than the first reference value, it is detected whether or not the converted electrical signal is greater than the second reference value (ST11).

As a result, if the converted electrical signal is not greater than the second reference value, the driving mode selector 3*a* in the controller 3 selects the third driving mode and the controller 3 outputs a driving mode control signal corresponding to the third driving mode (ST12).

Then, the driver 4 outputs the driving current and the actual driving voltage corresponding to the third driving mode in accordance with the driving mode control signal output from the controller 3 (ST9 and ST10).

In other words, the driving current controller 4*a* in the driver 4 controls the driving current of the third driving mode in accordance with the driving mode control signal of the controller 3. The driving voltage controller 4*b* outputs a signal for controlling the actual driving voltage corresponding to the driving voltage of the third driving mode in accordance with the driving mode control signal of the controller 3. The driving voltage generator 4*c* generates the actual driving voltage corresponding to the third driving mode in accordance with the control signal output from the driving voltage controller 4*b*. The driving driver 4*d* drives the panel in the third driving mode in accordance with both the driving current output from the driving current controller 4*a* and the actual driving voltage of the third driving mode generated by the driving voltage generator 4*c* (ST3 and ST4).

Meanwhile, if the converted electrical signal is greater than the second reference value, the driving mode selector 3*a* in the controller 3 selects the fourth driving mode and the controller 3 outputs a driving mode control signal of the fourth driving mode (ST13).

Then, the driver 4 outputs the driving current and the actual driving voltage corresponding to the fourth driving mode in accordance with the driving mode control signal output from the controller 3 (ST9 and ST10).

In other words, the driving current controller 4*a* in the driver 4 controls the driving current of the fourth driving mode in accordance with the driving mode control signal of the controller 3. The driving voltage controller 4*b* outputs a signal for controlling the actual driving voltage corresponding to the driving voltage of the fourth driving mode in accordance with the driving mode control signal of the controller 3. The driving voltage generator 4*c* generates the actual driving voltage corresponding to the fourth driving mode in accordance with the control signal output from the driving voltage controller 4*b*. The driving driver 4*d* drives the panel 5 in the fourth driving mode in accordance with both the driving current output from the driving current controller 4*a* and the actual driving voltage of the fourth driving mode generated by the driving voltage generator 4*c* (ST3 and ST4).

Meanwhile, the method for driving the self-emitting display device according to the present invention applied to portable electronic products such as a cellular phone will be described in detail.

In general, an organic EL display of the self-emitting display devices is driven at a lower voltage of about 10V or less as compared to a plasma display panel or an inorganic EL display, and has an excellent color sensitivity. In this respect, the organic EL display is likely to be applicable to the portable electronic products in the near future.

Therefore, by applying the driving method of the present invention to the portable electronic products with the organic EL display having low driving voltage, it is expected to effectively increase available time of the portable electronic product such as a cellular phone. In other words, the optical sensor is provided in the portable electronic product with an organic EL display panel having low power consumption to sense the intensity of light of the outside environment so that a corresponding driving mode is linearly selected. The organic EL display panel is automatically emitted at the emitting luminance corresponding to the driving current and the actual driving voltage of the selected driving mode.

In this way, the proper driving mode corresponding to the intensity of light is selected to control the emitting luminance of the organic EL display panel. Thus, it is possible to reduce power consumption of the device and maintain good visibility.

Furthermore, it is assumed that this invention applies to the cellular phone. In this case, only basic characters indicative of time and date, for example, are required to be recognized by the user when the cellular phone is not in use. Accordingly, the first driving mode is automatically selected to emit the panel at low emitting luminance.

Meanwhile, when the cellular phone is in use in the indoor, the second driving mode is automatically selected to emit the panel at higher emitting luminance than the first driving mode. When the cellular phone is in use in the dark and cloudy outdoor, the third driving mode is automatically selected to emit the panel at higher emitting luminance than the second driving mode. Also, when the cellular phone is in use in the bright outdoor, the fourth driving mode is automatically selected to emit the panel at higher emitting luminance than the third driving mode. The driving modes described in the aforementioned embodiment may be divided in more detail in accordance with the outside environment so as to achieve more preferable effects.

As aforementioned, the apparatus and method for driving a self-emitting display device according to the present invention has the following advantages.

Since the emitting luminance of the self-emitting display device becomes high only when the outer luminance is high, power consumption is small. Furthermore, since the emitting luminance of the panel is automatically controlled depending on the outside environment, it provides comfort to the sight of the user. Finally, since the driving current and the driving voltage are simultaneously controlled, it is possible to control the driving current and the driving voltage at a minimum power consumption.

It will be apparent to those skilled in the art that various modifications and variations can be made in the apparatus and method for driving a self-emitting display device according to the present invention without departing from the spirit or scope of the invention. Thus, it is intended that the present invention covers the modifications and variations of the invention provided they come within the scope of the appended claims and their equivalents.

What is claimed is:

1. An apparatus for driving a self-emitting display device the self-emitting display selected from organic electroluminescent displays, inorganic electroluminescent displays, field-emission displays, plasma displays, or light emitting diodes, the apparatus being provided with an optical signal converter for converting external light to an electrical signal and a display device, comprising:

a controller for providing a control signal for selecting a predetermined driving current and driving voltage in accordance with a signal converted by the optical signal converter and a signal indicating whether or not the display device is in use; and a driver for simultaneously providing the driving current and driving voltage in accordance with the control signal output from the controller, and automatically controlling emitting luminance of the display device and at the same time optimally setting power consumption, wherein the driver comprises:

a driving current controller for controlling the driving current in accordance with the driving mode control signal of the controller;

a driving voltage controller for controlling an actual driving voltage in accordance with the driving mode control signal of the controller;

a driving voltage generator for generating the actual driving voltage corresponding to the control signal output from the driving voltage controller; and a driving driver for driving a panel in accordance with both the driving current output from the driving current controller and the actual driving voltage generated by the driving voltage generator, and controlling the emitting luminance.

2. A method for driving a self-emitting display device the self-emitting display selected from organic electroluminescent displays, inorganic electroluminescent displays, field-emission displays, plasma displays, or light emitting diodes, in which the intensity of light of the outside environment is sensed to convert the sensed intensity of light to an electrical signal, comprising:

detecting whether or not a display device is in use;

outputting a control signal for selecting a predetermined driving current and driving voltage in accordance with the converted electrical signal representing the sensed light intensity;

controlling levels of the predetermined driving current and driving voltage in accordance with the control signal to set levels of an actual driving current and actual voltage;

outputting a second control signal for converting the predetermined driving current and driving voltage to a driving current of a minimum value and a driving voltage of a minimum value, if the display device is not in use as a result of the detecting step;

driving the display device by setting levels of an actual driving current of a minimum value and an actual driving voltage of a minimum value corresponding to the driving current and the driving voltage of the minimum value in accordance with the second control signal; and automatically controlling emitting luminance of the display device in accordance with the level of the predetermined driving current and the level of the actual driving voltage.

3. An apparatus for driving a self-emitting display device provided with an optical signal converter for converting external light and a display device, comprising:

a controller for selecting driving modes corresponding to a predetermined driving current and driving voltage in accordance with a signal converted by the optical signal converter and a signal indicating whether or not the display device is in use, and outputting a corresponding driving mode control signal; and a driver for simultaneously converting the driving current and driving voltage applied to the display device in accordance with the driving mode control signal output from the controller, and automatically controlling emitting luminance of the display device and at the same time optimally setting power consumption wherein the driver includes a driving current controller for controlling the current in accordance with the driving mode control signal of the controller, a driving voltage controller for controlling an actual driving voltage in accordance with the driving mode control signal of the controller, a driving voltage generator for generating the actual driving voltage corresponding to the control signal output to the driving voltage controller, and a driving driver for driving a panel in accordance with both the driving current output from the driving current controller and the actual driving voltage generated by the driving voltage generator.

4. An apparatus for driving a self-emitting display device provided with an optical signal converter for converting external light to an electrical signal and a display device, comprising:

a controller for selecting driving modes corresponding to a predetermined driving current and driving voltage in accordance with a signal provided by the optical signal converter and a signal indicating whether or not the display device is in use, and outputting a corresponding driving mode control signal; and a driver for simultaneously providing the driving current and driving voltage applied to the display device in accordance with the driving mode control signal output from the controller, and automatically controlling emitting luminance of the display device and at the same time optimally setting power consumption wherein the driving modes are divided into a plurality of driving modes and wherein a first driving mode is used indoor or outdoor at night, a second driving mode in bright indoor or rainy outdoor, a third driving mode in cloudy and shaded outdoor, and a fourth driving mode in bright indoor environments.

5. A method for driving a self-emitting display device in which the intensity of light of the outside environment is sensed to convert the sensed intensity of light to an electrical signal, comprising the steps of:

detecting whether or not a display device is in use;

selecting a first driving mode by setting a driving current and an actual driving voltage at a minimum value if the display device is not in use, to control emitting luminance of the display device;

comparing the converted electrical signal with a predetermined first reference value if the display device is in use;

selecting a second driving mode if the converted electrical signal is less than the first reference value;

comparing the converted electrical signal with a second reference value if the converted electrical signal is greater than the first reference value;

selecting a third driving mode if the converted electrical signal is less than the second reference value;

selecting a fourth driving mode if the converted electrical signal is greater than the second reference value;

setting a level of the driving current and a level of an actual driving voltage of the driving voltage in accordance with the selected driving mode; and automatically controlling the emitting luminance of the display device in accordance with the set driving current level and actual driving voltage level.

6. The method for driving a self-emitting display device as claimed in claim 5, wherein the first to fourth driving modes are set in accordance with a step wave form or a linear wave form varied by the outside environment.

7. An apparatus for driving a self-emitting display device the self-emitting display selected from organic electroluminescent displays, inorganic electroluminescent displays, field-emission displays, plasma displays, or light emitting diodes, the apparatus being provided with an optical signal converter for converting external light to an electrical signal and a display device, comprising:

a controller for selecting driving modes corresponding to a predetermined driving current and driving voltage in accordance with a signal provided by the optical signal converter and a signal indicating whether or not the display device is in use, and outputting a corresponding driving mode control signal; and a driver for simultaneously providing the driving current and driving voltage applied to the display device in accordance with the driving mode control signal output from the controller, and automatically controlling emitting luminance of the display device and at the same time optimally setting power consumption, wherein the driver comprises:

a driving current controller for controlling the driving current in accordance with the driving mode control signal of the controller; and a driving voltage controller for controlling an actual driving voltage in accordance with the driving mode control signal of the controller.

8. The apparatus for driving a self-emitting display device as claimed in claim 7, wherein the controller includes a driving mode selector for linearly selecting a driving mode corresponding to the predetermined driving current and driving voltage in accordance with the signal converted by the optical signal converter and the signal indicating whether or not the display device is in use.

9. The apparatus for driving a self-emitting display device as claimed in claim 7, wherein the driver further comprises:

a driving voltage generator for generating the actual driving voltage corresponding to the control signal output from the driving voltage controller; and a driving driver for driving a panel in accordance with both the driving current output from the driving current controller and the actual driving voltage generated by the driving voltage generator, and controlling the emitting luminance.

10. The apparatus for driving a self-emitting display device as claimed in claim 7, wherein the self-emitting display device is any one of an organic field emitting display device, an inorganic field emitting display device, an inorganic emitting diode, and a field effect display device.

11. The apparatus for driving a self-emitting display device as claimed in claim 7, wherein the driving modes are set in accordance with a step wave form or a linear wave form varied by the outside environment.

12. The apparatus for driving a self-emitting display device as claimed in claim 7, wherein the driving modes are divided into first to fourth driving modes.

13. The apparatus for driving a self-emitting display device as claimed in claim 12, wherein the first driving mode is used in the indoor or the outdoor at night, the second driving mode in the bright indoor or the rainy outdoor, the third driving mode in the cloudy and shaded outdoor, and the fourth driving mode in the bright outdoor.

14. A method for driving a self-emitting display device in which the intensity of light of the outside environment is sensed and the sensed intensity of light is converted to an electrical signal, comprising:

detecting whether or not a display device is in use;

linearly selecting a driving mode of a driving current and driving voltage by comparing the converted electrical signal representing the sensed light intensity with predetermined reference values, and outputting a corresponding driving mode control signal;

setting a level of the driving current and a level of an actual driving voltage of the driving voltage in accordance with the driving mode control signal; and automatically controlling emitting luminance of the display device in accordance with the set driving current level and actual driving voltage level wherein a plurality of driving modes are employed, a first driving mode being used indoor or outdoor at night, a second driving mode being used in bright indoor or rainy outdoor, a third driving mode being used in cloudy and shaded outdoor, and a fourth driving mode being used in bright indoor environments.

15. The method of driving a self-emitting display device as claimed in claim 14, wherein the step of outputting the driving mode control signal includes the steps of:

selecting a first driving mode by setting the driving current and the actual driving voltage at a minimum value if the display device is not in use as a result of the detecting step to control the emitting luminance of the display device;

comparing the converted electrical signal with the predetermined first reference value if the display device is in use; and selecting second to fourth driving modes in accordance with the comparted result.

16. The method for driving a self-emitting display device as claimed in claim 14, wherein the step of selecting the second to fourth driving modes includes the steps of:

selecting the second driving mode if the converted electrical signal is less than the first reference value;

selecting the third driving mode if the converted electrical signal is less than the second reference value; and selecting the fourth driving mode if the converted electrical signal is greater than the second reference value.

17. The method for driving a self-emitting display device as claimed in claim 14, wherein the first driving mode is used in the indoor or the outdoor at night, the second driving mode in the bright indoor or the rainy outdoor, the third driving mode in the cloudy and shaded outdoor, and the fourth driving mode in the bright outdoor.

18. The method for driving a self-emitting display device as claimed in claim 14, wherein the first to fourth driving modes are set in accordance with a step wave form or a linear wave form varied by the outside environment.

* * * * *